United States Patent [19]

Ikeda

[11] 3,945,445

[45] Mar. 23, 1976

[54] BORING APPARATUS PROVIDED WITH DRILL BITS FREELY ROTATABLE AROUND THEIR OWN AXIS

[75] Inventor: Nobuhisa Ikeda, Yokohama, Japan

[73] Assignee: Tone Boring Company Limited, Tokyo, Japan

[22] Filed: Oct. 4, 1974

[21] Appl. No.: 512,067

[30] Foreign Application Priority Data

| | | |
|---|---|---|
| Oct. 15, 1973 | Japan | 48-115482 |
| Dec. 11, 1973 | Japan | 48-140116 |
| Dec. 20, 1973 | Japan | 48-143225 |

[52] U.S. Cl. ..... 175/319

[51] Int. Cl.[2] ..... E21B 3/08

[58] Field of Search ..... 175/319, 96

[56] References Cited

UNITED STATES PATENTS

| | | | |
|---|---|---|---|
| 1,140,673 | 5/1915 | Giggey | 175/319 |
| 1,417,363 | 5/1922 | Wadsworth | 175/319 |
| 1,551,783 | 9/1925 | Baptie | 175/319 |
| 2,563,913 | 8/1951 | Binney | 175/319 |
| 3,285,351 | 11/1966 | Caro | 175/319 |
| R25,470 | 11/1963 | Allimann | 175/319 |

FOREIGN PATENTS OR APPLICATIONS

| | | | |
|---|---|---|---|
| 68,288 | 1942 | Norway | 175/319 |
| 122,464 | 1962 | U.S.S.R. | 175/319 |
| 170,358 | 1951 | Austria | 175/319 |

*Primary Examiner*—James A. Leppink

*Attorney, Agent, or Firm*—Spensley, Horn and Lubitz

[57] ABSTRACT

A boring apparatus in which a plurality of drill bits are supported in a casing fixed to a boring pipe in such a manner that these bits are axially substantially parallel with the axis of the boring pipe and are freely rotatable around their own axis independently of the rotation of the boring pipe.

14 Claims, 15 Drawing Figures

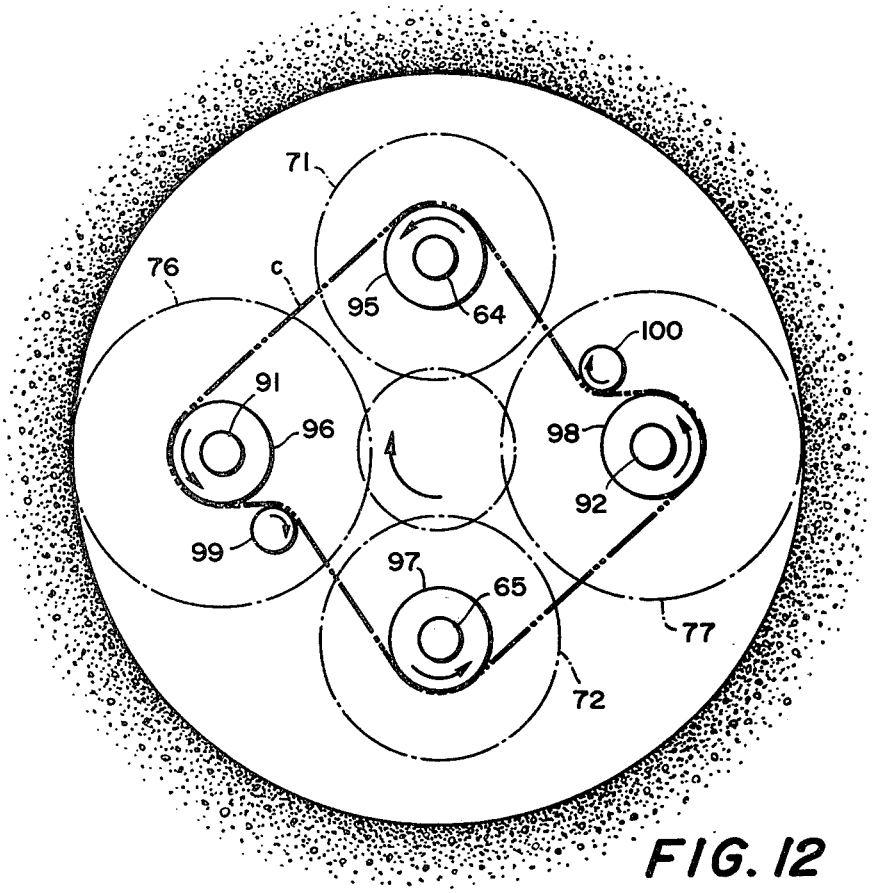
FIG. 12
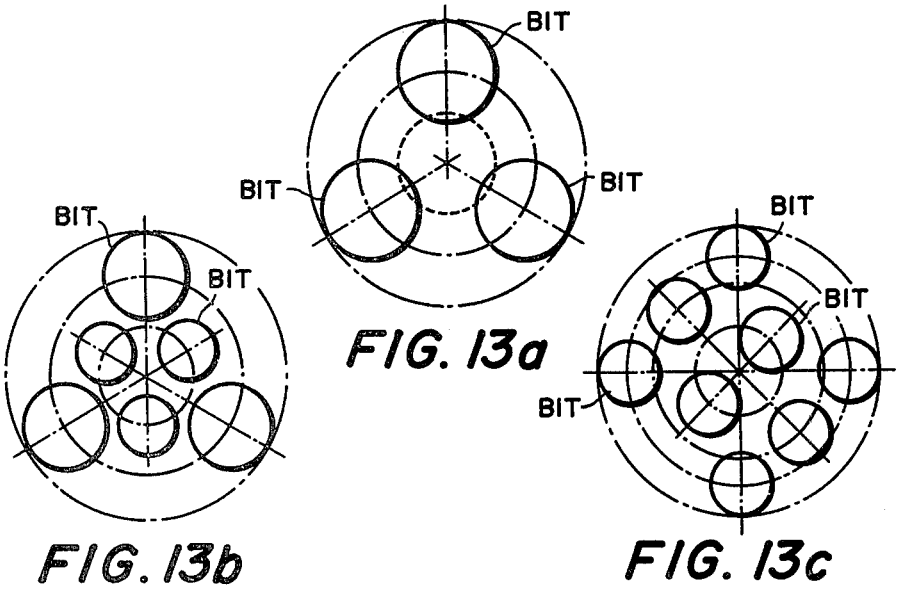
FIG. 13a
FIG. 13b
FIG. 13c

BORING APPARATUS PROVIDED WITH DRILL BITS FREELY ROTATABLE AROUND THEIR OWN AXIS

BACKGROUND OF THE INVENTION

This invention relates to boring apparatus, and more particularly to a boring apparatus provided with a plurality of drill bits which are supported in a casing assembly fixed to a boring pipe in such a manner that these drill bits are freely rotatable around their own axis without any direct relationship with the rotation of the boring pipe and the axis of rotation of each of these drill bits is substantially parallel to the axis of rotation of the boring pipe.

A boring machine of the kind provided with a plurality of drill bits capable of boring movement along a trochoidal curve is commonly known and has such a construction that each individual drill bit is arranged for rotation around its own axis and around the axis of the boring pipe in interlocking relation with the rotation of a boring pipe. This prior art boring machine comprises generally a central shaft connected to the boring pipe. In this prior art boring machine, a sun gear and a central casing are mounted on this central shaft and planet gears connected to the drill bits are mounted in the central casing for meshing engagement with the sun gear. Due to this construction, a rotating force is transmitted from the rotating boring pipe to the individual drill bits through the sun gear and planet gears so that the individual drill bits can be forcedly rotated around the axis of the boring pipe and around their own axis.

Therefore, the prior art boring machine having a construction as above described is defective in that a bulky gearing is required resulting in a high cost. Further, when it is desired to change the diameter of a hole to be bored, that is, when it is desired to change the pitch of the drill bits, the gears in the gearing must be replaced by other suitable gears or intermediate gears must be incorporated in the gearing. This gear replacing operation is very troublesome. Some of the drill bits are arranged on a circle of small radius and the others are arranged on a circle of large radius when it is desired to bore a hole of relatively large diameter. In such a case, the drill bits disposed in the radially inner position are driven in a direction opposite to the direction of rotation of the drill bits disposed in the radially outer position for the sake of simplicity of construction, and this arrangement results in such a defect that removed earth and sand tends to be trapped between the drill bits. This trapped earth and sand obstracts the rotation of the drill bits around their own axis and the motion of the drill bits is limited to the rotation around the axis of the boring pipe in integral relation with the boring pipe, with the result that the boring efficiency is extremely reduced. The present invention obviates such prior art defects.

SUMMARY OF THE INVENTION

It is therefore an object of the present invention to provide a novel and improved boring apparatus which is free from defects as above pointed out, which is simple in construction, in which the pitch can be easily changed, and which can operate with an excellent performance for the boring.

This excellent performance is attained by an arrangement in which a plurality of drill bits are supported in a casing assembly fixed to a boring pipe in such a manner that the drill bits are axially substantially parallel with the axis of the boring pipe and are freely rotatable independently of the rotation of the boring pipe.

Due to the fact that the drill bits are disposed to be freely rotatable without any direct relationship with the rotation of the boring pipe in the manner above described, all the freely rotatable drill bits are rotated in the same direction by a frictional force imparted thereto when the boring pipe is driven for boring. As a result, the drill bits bore a hole while rotating around the axis of the boring pipe and around their own axis thereby providing satisfactory boring efficiency.

Therefor, according to one aspect of the present invention, the casing assembly is formed integrally with a body, within which the drill bits are journalled in bearings. However, the casing assembly is formed with separate bodies, at least one of which supports the drill bits with free rotation. The separate bodies are connected together with, for example, bolt means, but these are easily detachable. In case of separate bodies, the casing assembly consists of central casing fixed to a boring pipe and bit supporting casings, and therefor the alteration of the pitch is realized.

The easiness of the alteration of the pitch, which is one of the objects of the present invention, is achieved by the fact that adjustable block members can be inserted between the central casing and the casings supporting the drill bits. The alteration of the pitch and adjustment of the angle of inclination of the drill bits can be attained by insertion of said block members of suitable thickness, and this ensures satisfactory performance of the apparatus.

The drill bits supported by these casings have the same cutting edge lower surface. However, one feature of the present invention, the drill bits may be arranged in suitable axially stepped relation to provide an offset between the cutting edge level of one bit and that of another thereby providing better performance.

In the present invention, an interlocking means is provided for causing rotation of the freely rotatable drill bits in interlocking relation with one another so that the drill bits can be rotated in the same direction while cooperating with one another thereby obviating such a trouble that one or more of the drill bits cease rotation due to trapping of removed earth and sand.

In the present invention, a bore reshaping bit is provided on the outer side face of each of the casings so that the wall surface of the hole bored in the form of a petal by the drill bits can be reshaped in a substantially true cylindrical surface.

In the present invention, a gearing or a chain is employed to constitute the interlocking means so as to reliably and easily adjustably attain the interlocking operation of the freely rotatable drill bits.

The above and other objects, features and advantages of the present invention will become apparent from the following detailed description taken in conjunction with the accompanying drawings.

BRIEF DESCRIPTION OF THE DRAWINGS

FIG. 12 is a diagrammatic view showing another form of interlocking means for the drill bits.

FIGS. 13*a*, 13*b* and 13*c* are diagrammatic views showing other bit arrangements.

DETAILED DESCRIPTION OF THE PREFERRED EMBODIMENTS

Before describing the present invention in detail, a prior art boring apparatus will be briefly described.

Figure 1:
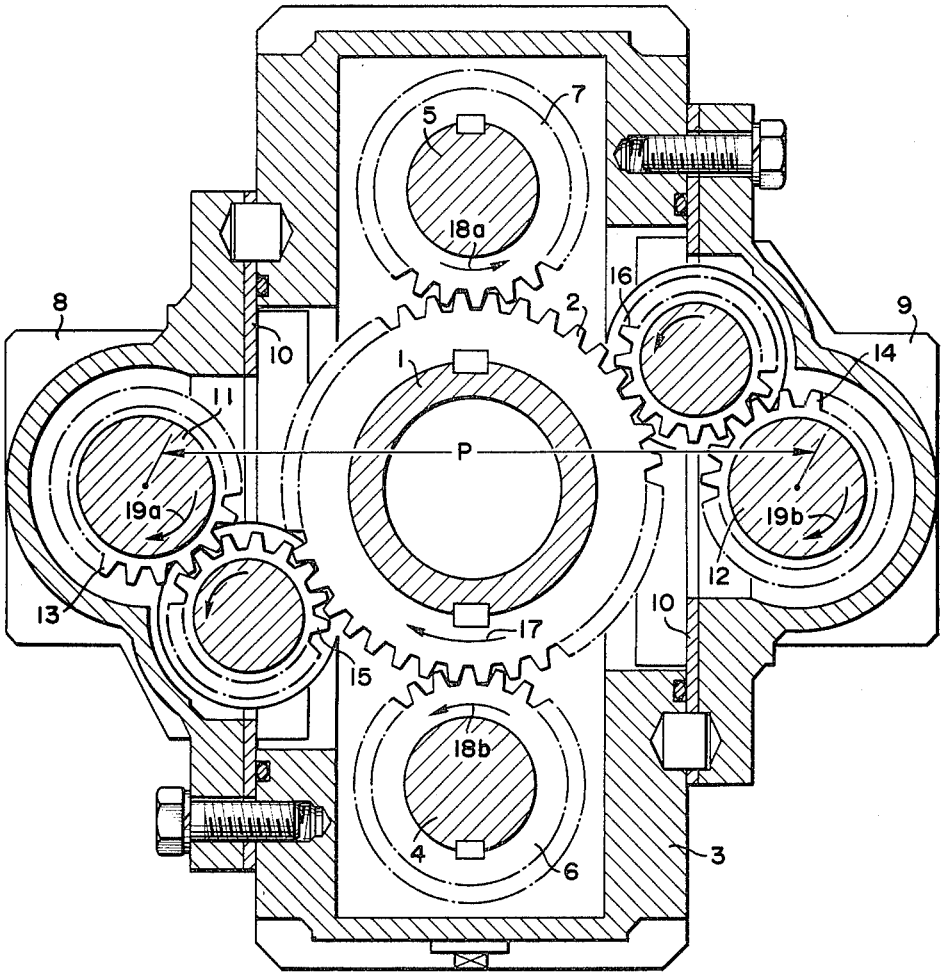
FIG. 1 PRIOR ART
FIG. 1 is a cross-sectional view of a prior art boring apparatus of the variable pitch type.

Referring to FIG. 1, a sun gear 2 is mounted on a boring pipe 1 for unitary rotation with the boring pipe 1. A central casing 3 is rotatably supported by the boring pipe 1. A pair of drill bits (not shown) are disposed on opposite sides of the boring pipe 1 and are rotatably supported in this central casing 3 and casings 8 and 9. Planet gears 6 and 7 are mounted respectively on the shaft portions 4 and 5 of these drill bits for meshing engagement with the sun gear 2. Casings 8 and 9 are detachably mounted to opposite side walls respectively of the central casing 3 with shim members 10 interposed therebetween. Planet gears 13 and 14 are mounted respectively on the shaft portions 11 and 12 of these drill bits. These planet gears 13 and 14 are in meshing engagement with the sun gear 2 through intermediate idle gears 15 and 16 supported suitably in the central casing 3. In this prior art boring apparatus, adjustment of the diameter of a hole to be bored, that is, adjustment of the pitch P is carried by changing the shim members 10 and replacing or adjusting the position of the intermediate idle gears 15 and 16.

In the boring operation with the boring apparatus having such a construction, the boring pipe 1 is rotated to transmit a rotating force to the drill bits through the sun gear 2, and the central casing 3 is rotated by a rotating force from the rotating source such as electric motor installed on the earth. Therefore, the drill bits rotate around the axis of the boring pipe 1 while rotating around their own axis. However, when the boring pipe 1 rotates clockwise as shown by the arrow 17, the bit shafts 4 and 5 supported in the central casing 3 rotate counterclockwise as shown by the arrows 18*a* and 18*b*, and the bit shafts 11 and 12 supported in the casings 8 and 9 rotate clockwise as shown by the arrows 19*a* and 19*b*. Therefore, the drill bits carried by the bit shafts 11 and 12 rotate in a direction opposite to the direction of rotation of the drill bits carried by the bit shafts 4 and 5. Thus, removed earth and sand tends to be trapped between the adjacent drill bits to limit the rotation of the drill bits around their own axis. As a result, the central casing 3, the casings 8, 9 and drill bits will rotate in integral relation with the boring pipe 1 and the boring efficiency will be extremely reduced.

The present invention is intended to eliminate such defects of the prior art apparatus as described above. A few preferred embodiments of the present invention will now be described in detail with reference to FIGS. 2 to 13.

Figure 2:
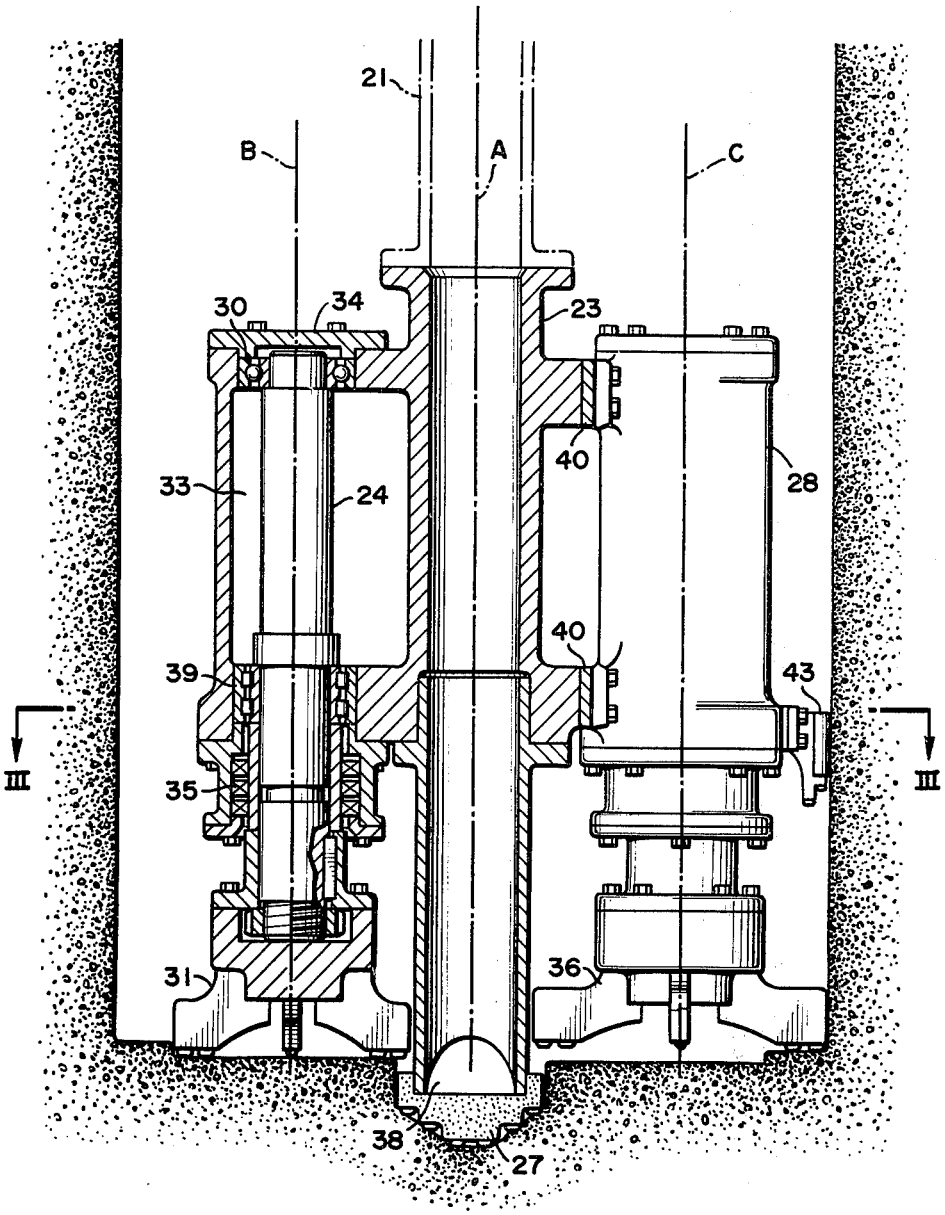
FIG. 2 is a vertical sectional view of an embodiment of the boring apparatus according to the present invention, the section being taken on the line II—II in FIG. 3.
Figure 3:
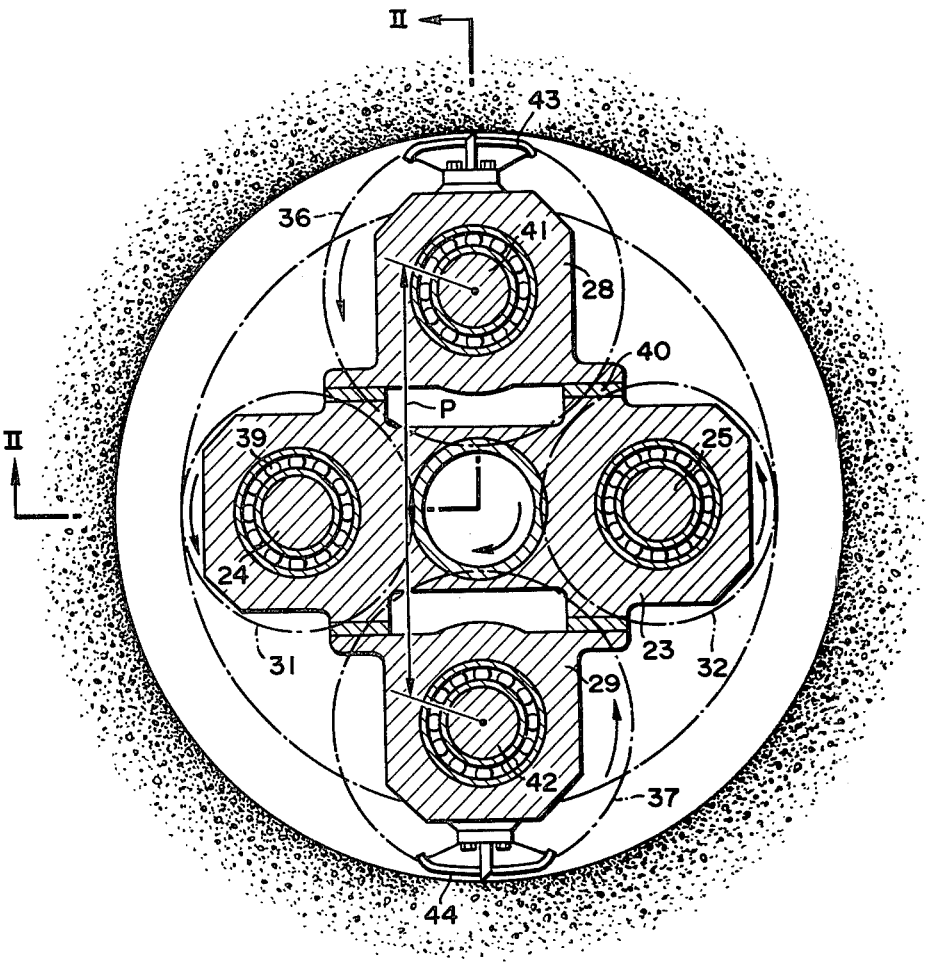
FIG. 3 is a cross-sectional view of the boring apparatus shown in FIG. 2, the section being taken on the line III—III in FIG. 2.

Referring to FIGS. 2 and 3 showing an embodiment of the present invention, a central casing 23 is firmly bolted to the lower end of a boring pipe 21. Casings 28 and 29 are detachably fixed to opposite side walls of the central casing 23. This central casing 23 has a hollow space therein, and a central drill bit 27 is detachably mounted to the lower end of the central casing 23. An opening 38 is formed in a lower side wall portion of the central casing 23 so that the slime removed by the boring operation can be discharged to the earth surface through the central casing 23 and boring pipe 21.

The central casing 23 supports rotatably bit shafts 24 and 25 on opposite sides of the axis of rotation A of the boring pipe 21. These bit shafts 24 and 25 are journalled freely rotatable in bearings 30 and 39 to be supported in parallel with the axis of rotation A of the boring pipe 21. Drill bits 31 and 32 are respectively detachably fixed to the lower end portion of the bit shafts 24 and 25. Thus, these drill bits 31 and 32 are disposed to be freely rotatable independently of the rotation of the boring pipe 21. Each of these drill bits 31 and 32 has its cutting edge surfaces arranged to lie in a plane perpendicular to the axis of rotation B thereof. The spaces 33 surrounding the bit shafts 24 and 25 within the central casing 23 are maintained fluid-tight against the exterior by means of cover members 34 and sealing members 35, and bearing lubricating oil is filled in these spaces 33.

The casings 28 and 29 are independent of the central casing 23, and bit shafts 41 and 42 (FIG. 3) are supported respectively therein in a manner similar to the manner of supporting the bit shafts 24 and 25. These bit shafts 41 and 42 extend downward, and drill bits 36 and 37 are detachably fixed to the lower end portion of these bit shafts 41 and 42 respectively. In one feature of the invention these casings 28 and 29 are firmly bolted to the central casing 23 with an adjustable block member 40 such as shim member interposed between each of them and the central casing 23, and each of these bit shafts 41 and 42 is disposed in such a manner that the axis of rotation C thereof is parallel with the axis of rotation A of the boring pipe 21. Each of the drill bits 36 and 37 has its cutting edge surface arranged to lie in a plane perpendicular to the axis of rotation A like the drill bits 31 and 32, and the cutting edges of the drill bits 36 and 37 are arranged to lie at a position slightly above the position of the cutting edges of the drill bits 31 and 32 as shown in FIG. 2. The drill bits 36 and 37 have a boring radius greater than that of the drill bits 31 and 32. The pitch P between these drill bits 36 and 37 can be adjusted by adjusting the thickness of the adjustable block members 40. Bore reshaping bits 43 and 44 may be mounted to the outer side face of the respective casings 28 and 29, so that the wall surface of the bore being bored by the drill bits 36 and 37 can be reshaped into a substantially true cylindrical surface.

In the boring operation with the boring apparatus having a construction as above described, the boring pipe 21 is rotated and propelled downward by a drive source (not shown) while supplying water in the hole being bored, and the slime removed by boring is discharged from the opening 38 of the central casing 23 to the earth surface via the central casing 23 and boring pipe 21. In this operation, the drill bits 31, 32, 36 and 37 rotate around the axis of rotation A of the boring pipe 21. In addition, due to the fact that the cutting edges of the individual drill bits making rotation around the rotating axis A of the boring pipe 21 are encountered by boring resistances which differ between inner and outer side of the individual bit depending on the radial position relative to the rotating axis A of the boring pipe 21, rotating forces are produced tending to cause rotation of the individual drill bits 31, 32 and 36, 37 around the respective axis of rotation B and C.

Figure 9:
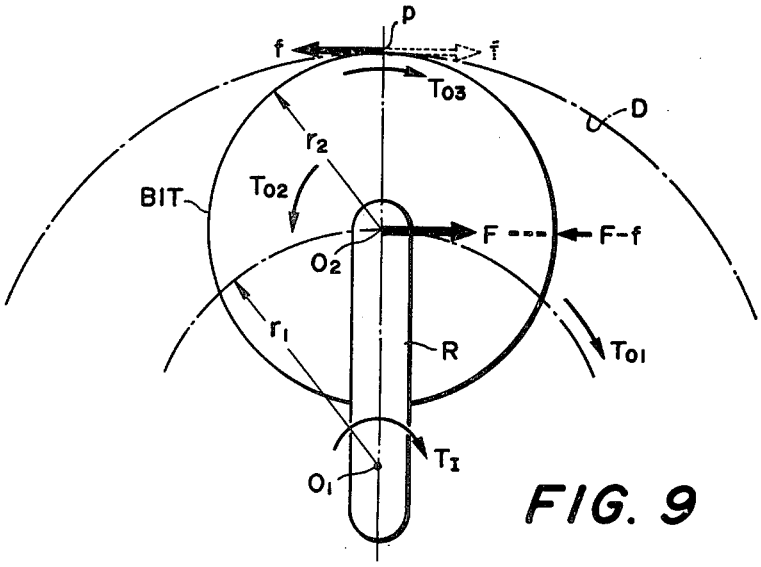
FIG. 9 is a diagram showing various forces acting upon a freely rotatable drill bit.

The mechanism with which the drill bits are caused to rotate around their own axis will be described in more detail with reference to FIG. 9. Referring to FIG. 9, suppose that a torque $T_I$ is imparted to a rod R to cause clockwise rotation of a drill bit around a point $O_1$ corresponding to the rotating axis A. Then, a tangential force F acting upon the center $O_2$ of the drill bit is given by $F = T_1/r_1$ where $r_1$ is the radius of rotation of the drill bit around the point $O_1$. Suppose that a resistance force encountered by the drill but during boring is expressed as a force $f$ acting upon a point $p$. Then, the resistance force resisting the rotation of the drill bit around the point $O_1$ is $F = f$ when the rotation of the drill bit is not taken into account. In this case, a torque $T_{01}$ tending to cause rotation of the drill bit around the point $O_1$, a torque $T_{02}$ tending to cause rotation of the drill bit around its center $O_2$, and a torque $T_{03}$ produced in a direction tangential to the wall of the bored hole as a reaction against the rotation of the drill bit around its center $O_2$, are given by the following equation:

$$T_{01} = (F - f)\, r_1 = (T_1/r_1 - f)\, r_1 = T_I - fr_1 \quad (1)$$

$$T_{02} = -fr_2 \quad (2)$$

$$T_{03} = f\,(r_1 + r_2) = fr_1 + fr_2 \quad (3)$$

It will be seen that the balance of the torques given by the relation $T_I = T_{01} + T_{02} + T_{03}$ holds. This is also testified by a formula of energy. In other words, the torque $T_{02}$ tending to cause rotation of the drill bit around its center $0_2$ is produced in view of the fact that the force $f$ due to the boring resistance is $f \neq 0$.

Further, these torques $T_{01}$, $T_{02}$ and $T_{03}$ work independently of one another, and the amounts of work in the respective directions of rotation are independently of one another. Thus, the absolute value of the composite output torque $|T_0|$ is expressed as $$|T_0| = |T_{01}| + |T_{02}| + |T_{03}| = T_I + 2fr_2 \quad (4)$$

Suppose that the resistance ratio $f/F = x$ and the radius ratio $r_2/r_1 = \rho$, then the equation (4) is expressed as $$|T_0| = T_I + 2\, r_2/r_1 \times T_I = (1 + 2\rho x)\, T_I \quad (5)$$

Figure 10:
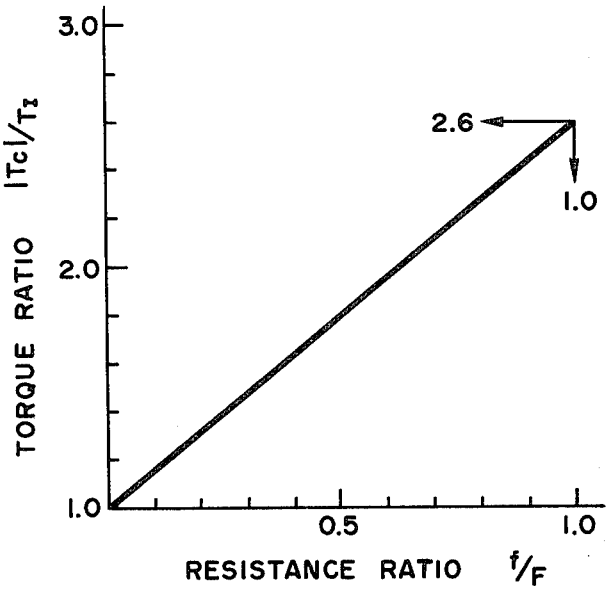
FIG. 10 is a diagram showing the relation between the resistance ratio and the torque ratio in the freely rotatable drill bit.

When $\rho$ in the equation (5) is substituted by the radius ratio $\rho = 4/5$ commonly employed in apparatus of this kind, the relation shown in FIG. 10 is obtained. It will thus be seen that, due to the fact that the total sum of the individual output torques imparted to the drill bit is greater than the torque $T_I$ transmitted by the rod R, a reduced load torque need be imparted to the rod R for the boring operation by the drill bit, and the load of the rod R required during the boring operation is decreased with the increase in the resistance force $f$ imparted to a point which is radially remote from the point $0_1$.

Figure 11:
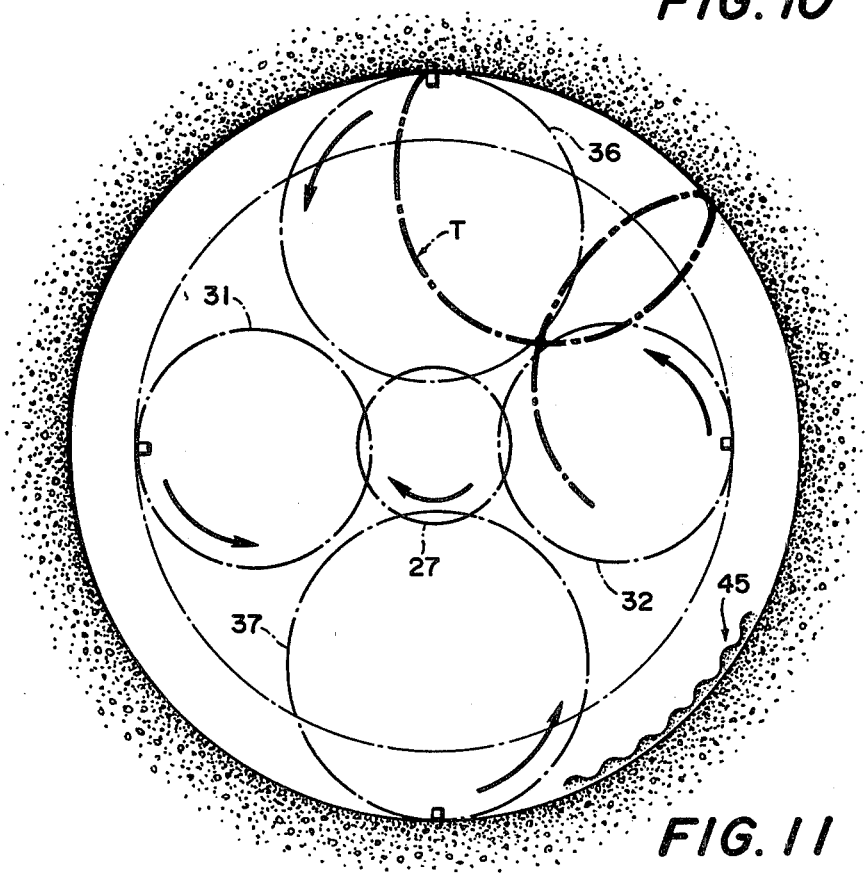
FIG. 11 is a diagrammatic view showing the motion of the freely rotatable drill bits during the boring operation.

For the reasons above described, the individual drill bits 31, 32, 36 and 37 rotate around the rotating axis A of the boring pipe 21 and around their own axis, and the direction of rotation of these drill bits around their own axis is opposite to the direction of rotation around the rotating axis A of the boring pipe 21. Therefore, when a point of the drill bit 36 is noted, for example, this point moves along a curve T or a trochoidal curve as shown in FIG. 11 thereby exhibiting an excellent boring efficiency. However, boring by the drill bits drawing the trochoidal locus results in formation of petal-like irregularity 45 on the wall surface of the bored hole. This petal-like irregularity 45 is removed and the bored wall surface is reshaped by the reshaping bits 43 and 44. As a result of such reshaping, a hole substantially completely circular in cross section can be obtained.

Figure 4:
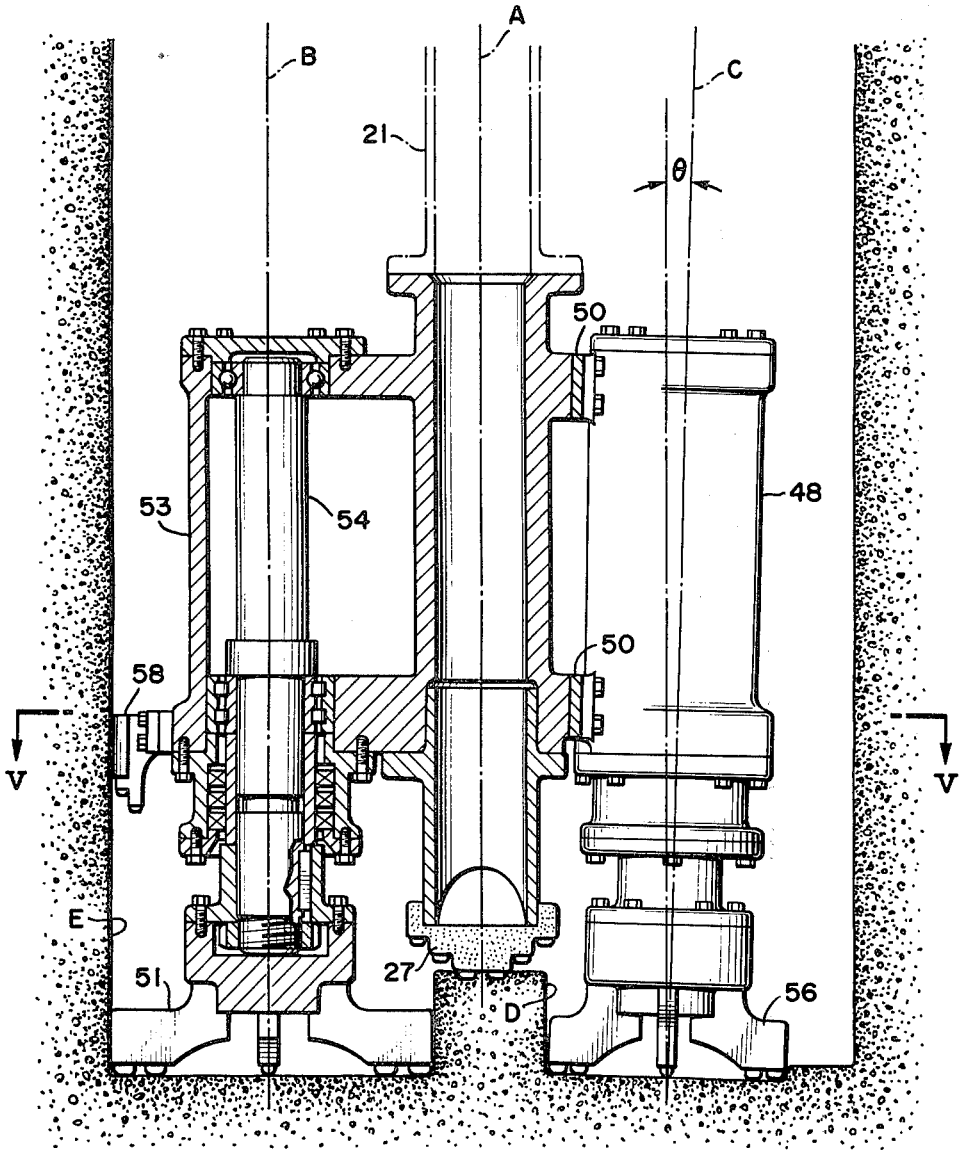
FIG. 4 is a vertical sectional view of another embodiment of the present invention, the section being taken on the line IV—IV in FIG. 5.
Figure 5:
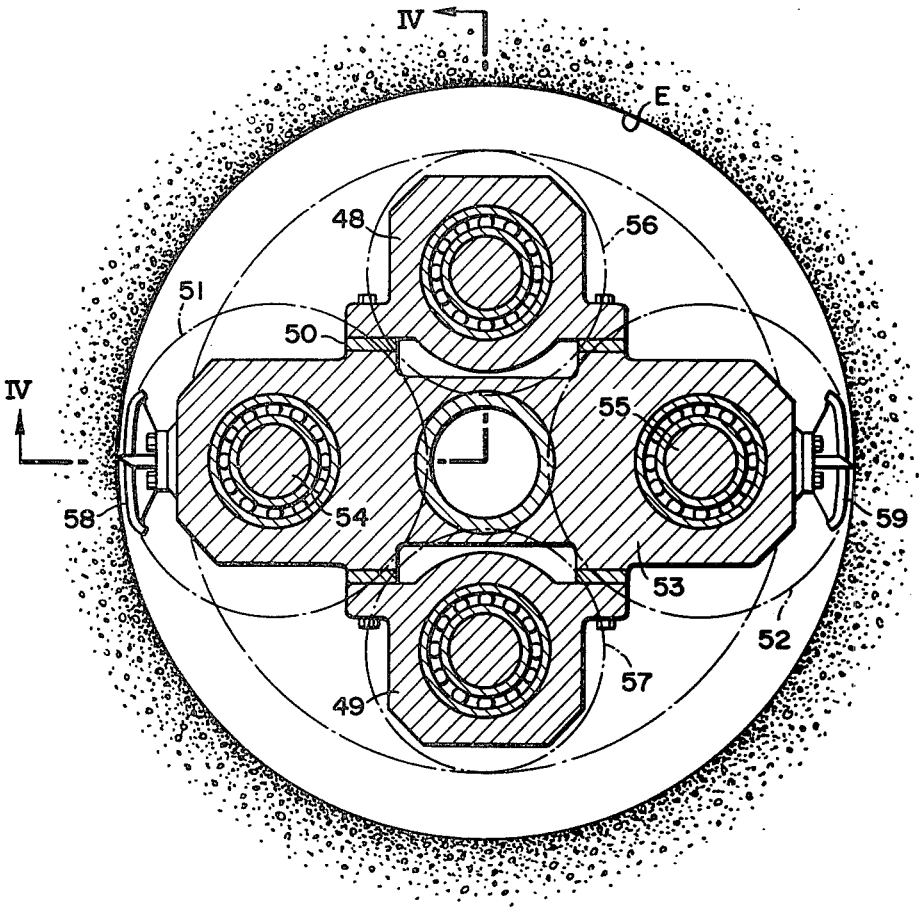
FIG. 5 is a cross-sectional view of the boring apparatus shown in FIG. 4, the section being taken on the line V—V in FIG. 4.

FIGS. 4 and 5 show another embodiment of the present invention. In this embodiment, the drill bits 51 and 52 are supported in a central casing 53 with their axis of rotation B arranged in parallel with the axis of rotation A of a boring pipe 21 and have a large boring radius. The casings 48 and 49 are fixed to the central casing 53 through adjustable block members 50 as in the first embodiment. The axis of rotation C of each of other drill bits 56 and 57 supported in the respective casings 58 and 59 is inclined slightly inwardly toward the boring direction by an angle $\theta$ relative to the axis of rotation A of the boring pipe 21 as seen in FIG. 4. The boring radius of these drill bits 56 and 57 is smaller than that of the drill bits 51 and 52. A central drill bit 27 is situated above the drill bits 51, 52, 56 and 57, and the bore reshaping bits 58 and 59 are fixed to the outer side faces of the central casing 53 on opposite sides of the boring pipe 21.

The construction of the embodiment shown in FIGS. 4 and 5 is generally similar to that shown in FIGS. 2 and 3 except the arrangement specifically described above. In like manner, bit shafts 54 and 55 carrying the respective drill bits 51 and 52 are supported in the central casing 53. The casings 48 and 49 are fixed to the opposite side faces of the central casing 53 through the adjustable block members 50, and the longitudinal axis of each of these casings 48 and 49 inclines slightly inwardly toward the boring direction by a slight angle as above described. The central drill bit 27 is fixed to the lower end of the central casing 53.

Figure 6:
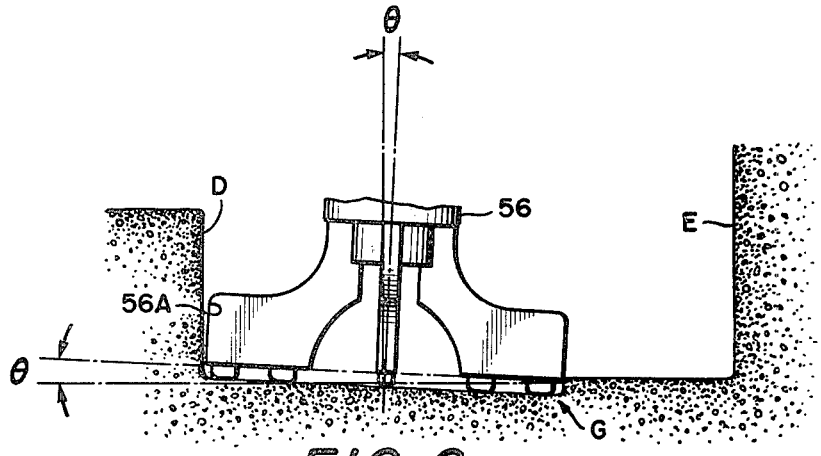
FIG. 6 is an enlarged view of a part of FIG. 4.

In the second embodiment having such a construction, the drill bits 51, 52, 56 and 57 bore a hole while rotating around the rotating axis A of the boring pipe 21 and around their own axis as in the first embodiment as the boring pipe 21 is rotated and propelled. As a result, the cutting edges of each drill bit draw a trochoidal locus. As specifically shown in FIG. 6, the inclined drill bits 56 and 57 in this second embodiment make boring operation while forming the surface D of the core. However, due to the fact that these drill bits 56 and 57 are inclined by the angle $\theta$ relative to the rotating axis A of the boring pipe 21, the outer peripheral surface portions 56A and 57A of the respective drill bits 56 and 57 do not substantially make boring engagement with the surface D of the core. In FIG. 6, at a side G nearer to the wall surface E of the bored hole, the boring resistance encountered by the drill bits 56 and 57 is increased at an outer side thereof due to the inclination, and an increased rotating force is imparted to the drill bits 56 and 57 due to this increased boring resistance encountered at this side G, this rotating force being larger than when no inclination is provided. A great rotating force is also imparted to the other drill bits 51 and 52 due to engagement with the wall surface E of the bored hole. Therefore, the boring efficiency can be improved by the arrangement above described. The angle of inclination $\theta$ is suitably adjusted by replacing the adjustable block members depending on the nature of the soil at the specific site.

Figure 7:
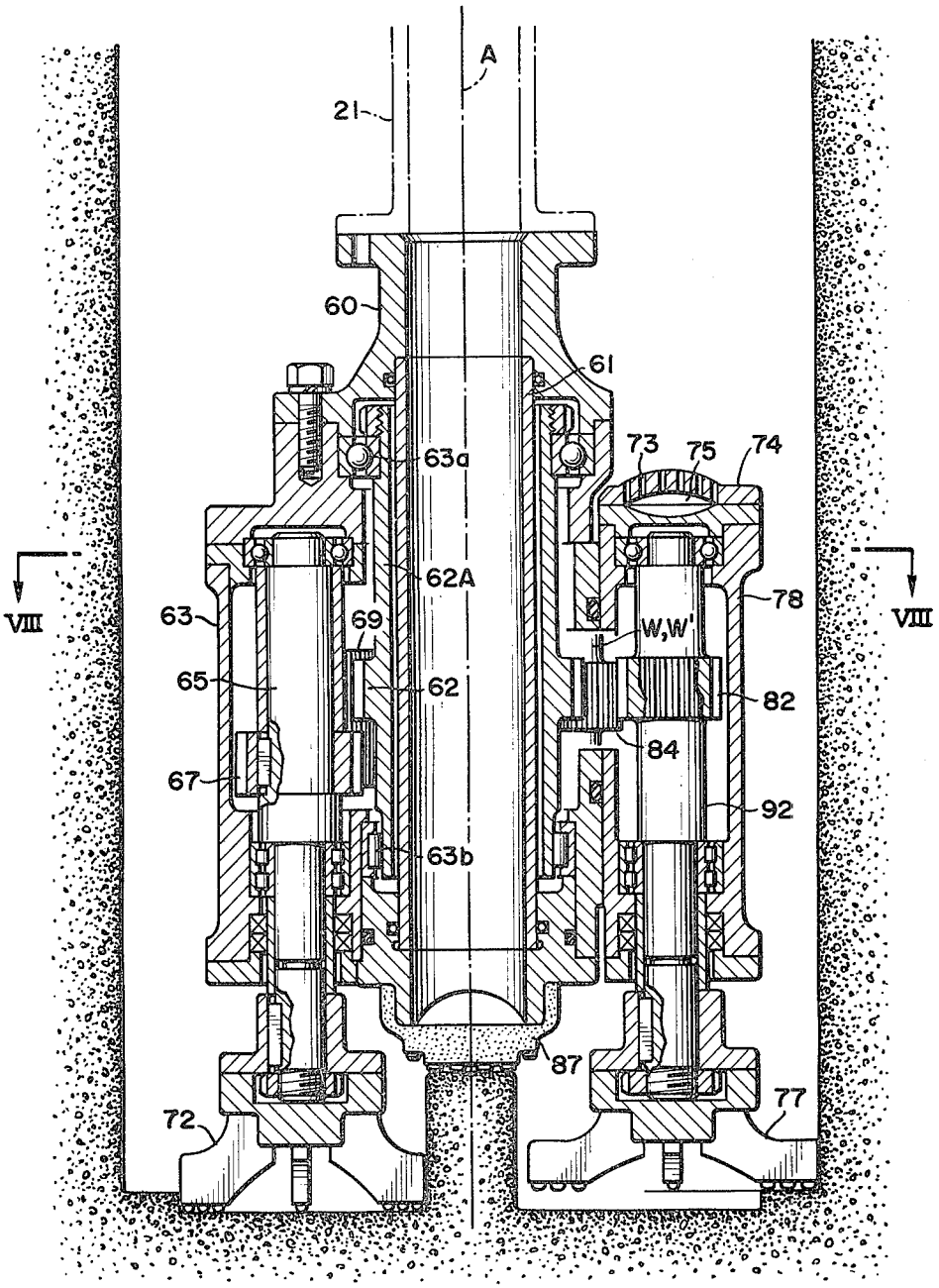
FIG. 7 is a vertical sectional view of still another embodiment of the present invention.
Figure 8:
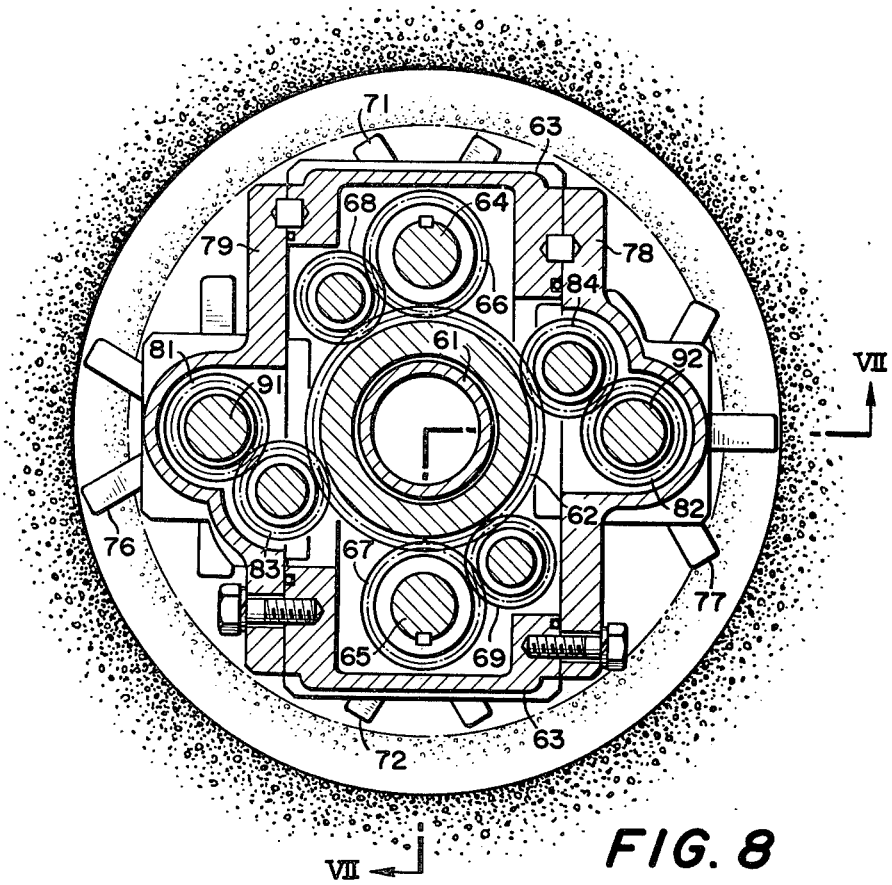
FIG. 8 is a cross-sectional view of the embodiment shown in FIG. 7, the section being taken on the line VIII—VIII in FIG. 7.

FIGS. 7 and 8 show still another embodiment of the present invention. Referring to FIGS. 7 and 8, a hollow central casing 63 is formed with openings W in its opposite side walls and is secured at the upper end thereof to a boring pipe 21 through a hollow connecting member 60. A cylindrical member 61 is disposed within this central casing 63 in such a relation that the central axis thereof coincides with the axis of rotation A of the boring pipe 21. This cylindrical member 61 is supported at the lower end thereof by a lower end portion of the central casing 63 and at the upper end thereof by the connecting member 60. Slime is discharged to the earth surface from the lower end opening of the central casing 63 through the cylindrical member 61, connecting member 60 and boring pipe 21. Hub 62A is journalled at opposite end thereof in bearings 63*a* and 63*b* of the casing portion. The hub 62A is formed with a gear 62 which is rotatably supported within the central casing 63 in coaxial relation with the axis of rotation A of the boring pipe 21. The hub 62A can rotate around the cylindrical member 61.

Gears 66 and 67 are keyed to respective bit shafts 64 and 65 supported within the central casing 63, and these gears 66 and 67 are not in direct meshing engagement with the central gear 62. Intermediate idle gears 68 and 69 are further provided in the central casing 63 as shown in FIG. 8 so as to bring the associated gears 66 and 67 into driven engagement with the central gear 62. These intermediate idle gears 68 and 69 are supported in a fixed position.

Casings 78 and 79 are formed with openings W′ opposite to the openings W in the side walls at which they are connected to the central casing 63. Gears 81 and 82 are formed on bit shafts 91 and 92 supported in the casings 79 and 78 respectively, and these gears 81 and 82 are disposed within the respective openings W′. These gears 81 and 82 are not in direct meshing engagement with the central gear 62 but are brought into meshing engagement with the central gear 62 by respective intermediate idle gears 83 and 84 disposed within the central casing 63 as shown in FIG. 8. These intermediate idle gears 83 and 84 are positioned so as to be engageable with the central gear 62 and the gear 81 or 82 within the central casing 63, and the most suitable meshing engagement is provided by adjustable block members inserted suitably between the casings 78, 79 and the central casing 63 for changing the pitch.

In this third embodiment, drill bits 76 and 77 are arranged to bore a range of large radius, and other drill bits 71 and 72 for boring a range of small radius are arranged in such a position that the cutting edges thereof are disposed below those of the drill bits 76 and 77. Further, the bit shafts of all these drill bits 71, 72, 76 and 77 are disposed in parallel with the axis of rotation A of the boring pipe 21, and a central bit 87 is disposed in an uppermost position. These axially offset relation of drill bits renders remarkable difference of the boring resistance, which causes an increased rotating force of the own axis of each bit. Lubricating oil is filled in all the casings as in the preceding embodiments. Cover members 74 covering the casings 78 and 79 are formed with many perforations 73 as seen in FIG. 7, and a diaphragm 75 is interposed between each of the casings 78, 79 and the associated cover member 74 to provide a fluid-tight seal. Such diaphragms 75 are deformed for compensating the difference between the internal pressure and the external pressure during boring operation.

In the third embodiment having a construction as above described, the freely rotatable drill bits 71, 72, 76 and 77 are interlocked with one another by the gear train so that they can rotate in the same direction. Therefore, during boring operation, forces tending to cause rotation of the drill bits 71, 72, 76 and 77 around their own axis are transmitted to one another thereby causing rotation of these drill bits around their own axis. Thus, it is possible to avoid an undesirable action such that crushed rocks or earth and sand may be trapped between some of the individual drill bits tending to obstruct rotation of the drill bits around their own axis.

The gearing shown in FIGS. 7 and 8 is arranged so as to permit alteration of the pitch and to cause rotation of all the drill bits in the same direction. However, when such alteration of the pitch is unnecessary, it is apparent that the intermediate idle gears 68, 69, 83 and 84 may be eliminated and the gears 65, 67, 81 and 82 may be arranged to engage directly with the central gear 62 thereby simplifying the construction.

Another form of the means for causing interlocking operation of the individual drill bits 71, 72, 76 and 77 is shown in FIG. 12. In the form shown in FIG. 12, an endless chain *c* is utilized in lieu of the gear train. Sprockets 95, 96, 97 and 98 are mounted on the bit shafts 91, 92, 64 and 65 carrying the drill bits 71, 72, 76 and 77 respectively, and the endless chain *c* is trained around these sprockets. A pair of idle sprockets 99 and 100 are disposed in the vicinity of the mounted position of the respective casings 78 and 79 in order to permit alteration of the pitch by the block members interposed between the central casing 63 and the casings 78, 79. The form shown in FIG. 12 is also effective in that the drill bits 71, 72, 76 and 77 can be rotated in interlocking relation in the same direction around their own axis and the reliability of maintaining the desired boring efficiency can be improved as in the embodiment using the gear train.

FIGS. 13*a*, 13*b* and 13*c* show other preferred bit arrangements according to the present invention. It is apparent from FIGS. 13*a* to 13*c* that a plurality of drill bits may be suitably arranged as shown.

It is to be understood that many changes and modifications may be made without departing from the spirit and scope of the present invention specified in the appended claims.

I claim:

1. A boring apparatus for boring holes in the ground comprising a plurality of downward extending drill bits and associated drill bit shafts, and a boring pipe, each said drill bit shaft and said boring pipe being rotatably supported in a casing assembly, each said drill bit shaft being rotatably journaled in an associated means for supporting each said drill bit shaft such that each said drill bit is freely rotatable about the axis of rotation of said associated drill bit shaft, said means arranged and configured such that the axis of rotation of each said drill bit shaft is substantially parallel to the axis of rotation of said boring pipe, said means for supporting each said drill bit shaft being coupled to said boring pipe, such that said means is non-rotatable about its own axis, said means being further characterized by an absence of any gear engaging member for engaging said boring pipe disposed along the outer periphery thereof, said boring pipe being disposed in said casing assembly such that said drill bit shafts circumferentially surround said boring pipe, said boring pipe being further characterized by a lack of any gear engaging members for engaging said means for supporting said drill bit shaft, said casing assembly coupling said boring pipe to each said drill bit shaft such that rotation of said casing assembly causes (i) said boring pipe to axially rotate; (ii) said means for supporting each said drill bit shaft to revolve about said axis of said boring pipe; and (iii) each said drill bit shaft and drill bit to rotate about said axis of said drill bit shaft in a direction of rotation opposite to the direction of rotation of said boring pipe.

2. The boring apparatus as claimed in claim 1, wherein said casing assembly comprises (i) a central casing coupled to said boring pipe, and (ii) bit-supporting casings, said bit-supporting casing being detachably secured to said central casing.

3. The boring apparatus as claimed in claim 2, wherein a block member of a predetermined thickness is interposed between said central casing and each said bit-supporting casings, thereby permitting selective adjustment of the pitch of said bits.

4. The boring apparatus as claimed in claim 1, wherein a predetermined number of said drill bits have their axis inclined inwardly toward the direction of said boring pipe relative to the axis of rotation of said boring pipe.

5. The boring apparatus as claimed in claim 1, wherein a predetermined number of said drill bits have their cutting edge surfaces arranged to lie in an axially offset relation from each other.

6. The boring apparatus as claimed in claim 1, wherein said casing is provided at the outer side thereof with a bore reshaping bit.

7. The boring apparatus as claimed in claim 2, wherein said boring pipe and said central casing coupled to said boring pipe are hollow, and an opening is provided in the lower end of said central casing.

8. The boring apparatus as claimed in claim 1, wherein an interlocking means is provided on said plurality of bits for causing rotation of said plurality of drill bits around their said axis of rotation and thereby interlocking with one another.

9. The boring apparatus as claimed in claim 8, wherein said interlocking means comprises a train of gears.

10. The boring apparatus as claimed in claim 8, wherein said interlocking means comprises a chain means.

11. The boring apparatus according to claim 1 wherein said means for supporting each said drill bit shaft is a bit-supporting casing circumferentially disposed about each said shaft adjacent the lower end of each said shaft, and said boring pipe is journaled in a central casing, each said bit-supporting casing being coupled to said central casing thereby forming said casing assembly.

12. The boring apparatus according to claim 11 wherein at least one boring reshaping bit is coupled to said bit-supporting casing such that said reshaping bit extends outward from and perpendicular to said bit-supporting casing.

13. The boring apparatus according to claim 1 wherein said means for supporting each said drill bit shaft is coupled to said boring pipe with a block member selectively disposed between said means for supporting each said drill bit shaft and said boring pipe, said block member thereby changing the pitch of said drill bits.

14. The boring apparatus according to claim 11 wherein a block member of a predetermined thickness is interposed between said central casing and each said bit-supporting casings thereby permitting selective adjustment of the pitch of said bits.

* * * * *